United States Patent [19]

Evert

[11] Patent Number: 4,545,773

[45] Date of Patent: Oct. 8, 1985

[54] SAILBOARDING PERSONAL FLOTATION DEVICE

[75] Inventor: Karla R. Evert, St. Cloud, Minn.

[73] Assignee: Stearns Manufacturing Company, St. Cloud, Minn.

[21] Appl. No.: 449,631

[22] Filed: Dec. 14, 1982

[51] Int. Cl.[4] ..... B63C 9/08

[52] U.S. Cl. ..... 441/114; 114/39; 182/3

[58] Field of Search ..... 441/110, 111, 112, 113, 441/114; 114/39, 39.1, 39.2; 182/3, 4, 5, 6, 7, 8, 9; 244/151 R, 151 A

[56] References Cited

U.S. PATENT DOCUMENTS

| | | | |
|---|---|---|---|
| 2,393,285 | 1/1946 | Brown | 441/110 |
| 2,427,828 | 2/1980 | Saby | 182/3 |
| 3,448,826 | 6/1969 | Rosenblum | 182/3 |

FOREIGN PATENT DOCUMENTS

| | | | |
|---|---|---|---|
| 539681 | 4/1957 | Canada | 244/151 R |
| 2324322 | 4/1977 | France | 182/3 |
| 2324506 | 4/1977 | France | 114/39 |

OTHER PUBLICATIONS

Sporting Goods Business, p. 70, Dec. 1982.
Offshore Products, Inc., p. 3.
Photographs of Mustang Sportswear, Inc. and the Stan Louden Products Ltd. Flotation Devices.

*Primary Examiner*—Trygve M. Blix
*Assistant Examiner*—Jesûs D. Sotelo
*Attorney, Agent, or Firm*—Merchant, Gould, Smith, Edell, Welter & Schmidt

[57] ABSTRACT

A personal flotation device (10) for use with a sailboard is disclosed. The device (10) comprises a buoyant body portion (12) having front and back sections (14 and 16, respectively) defining arm holes (26*a* and 26*b*) and a neck hole (28). The device further comprises hook (80) for releasably attaching the device to a line of a sailboard, straps 32, 48, 54, 62, and 68 for securing the body portion (12) to and quickly releasing it from the wearer, and flaps 38 and 40 and straps 32 and 54 for substantially distributing the stress, which arises from the pull of the sail and line, across the back of the wearer. The device (10) can further include tape 88 for self-adjusting the location of hook 80 to optimize the balance and comfort of the sailboard operator.

5 Claims, 8 Drawing Figures

FIG. 1
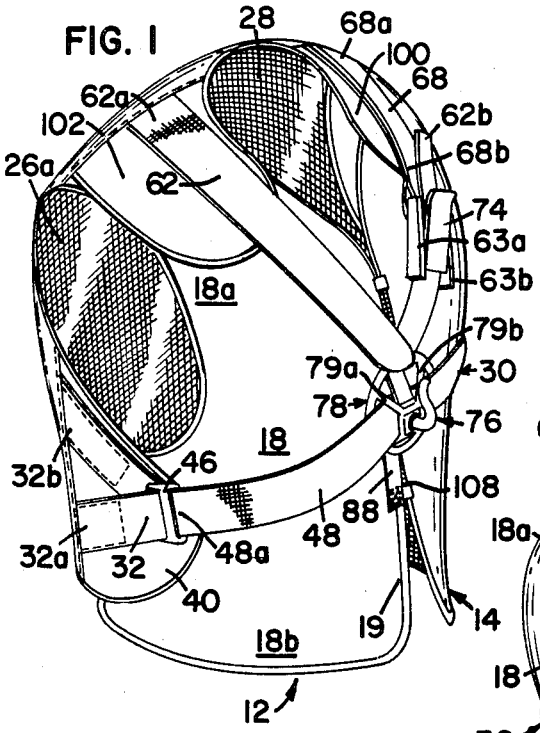
FIG. 2
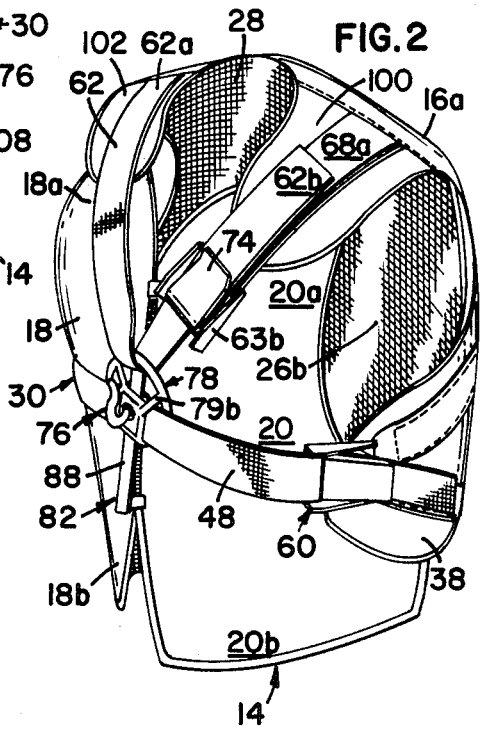
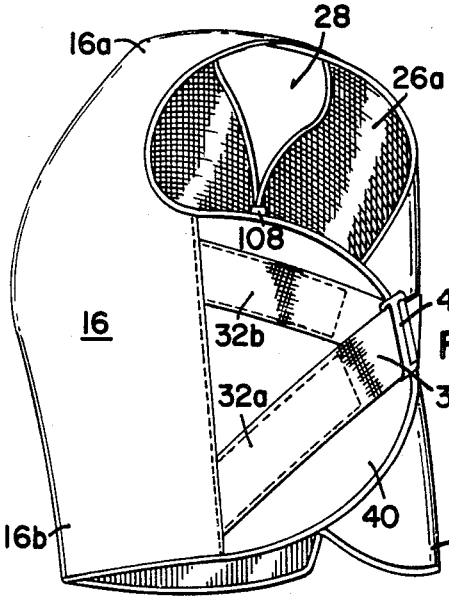
FIG. 3

FIG. 6
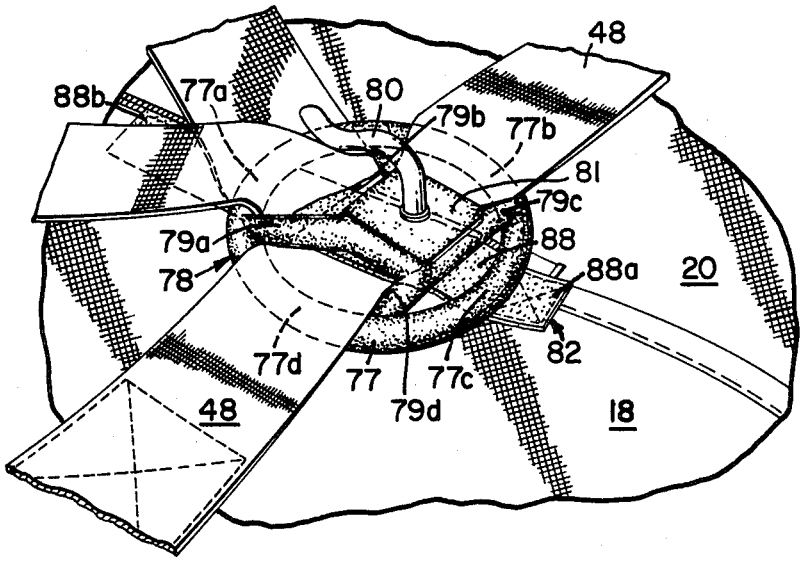
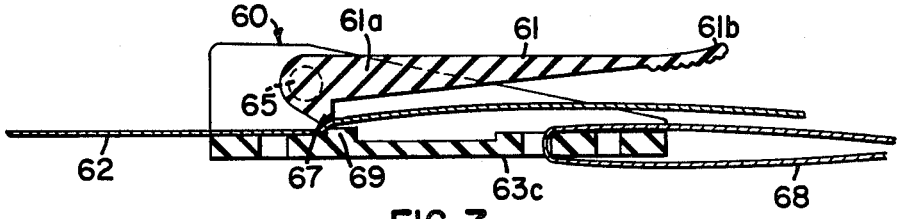
FIG. 7

SAILBOARDING PERSONAL FLOTATION DEVICE

TECHNICAL FIELD

The present invention relates generally to the field of personal flotation devices. More particularly, this invention relates to a sailboarding personal flotation device having a hook or other member which can be attached to the line of a sailboard, and in a preferred embodiment, an arrangement of straps, pads, and panels which provide increased balance, support and comfort to the wearer.

BACKGROUND OF THE INVENTION

Personal flotation devices for use with water sports are known in the art and have been used for some time. Typically such devices include a buoyant body portion and straps and buckles for securing the device on the wearer. Personal flotation devices have also been specifically designed for use by individuals operating a sailboat or a sailboard. Some of these devices include a hook at the front of the device for attachment to the line of the sailboat and sailboard. When an individual wears the device and hooks it to the line, the individual can lean back and be supported by the tension and strength of the line.

In particular, the sport of sailboarding can involve the constant use of the sailboard operator's arms and hands to maintain the correct position of the sail. Particularly when sailing over long distances and in strong winds, the operator's shoulders, arms, wrists and hands can become extremely fatigued or even strained from the raised position in which they are held, and from the continual stress resulting from the pull of the sail.

When the personal flotation device of this invention is attached to a line of the sailboard, the operator can then use his body to maintain the position of the sail, and thus have his arms free, relieving the constant tension and pull which they would normally experience. Prior art devices such as the Mustang Floater® SeaHorse series TM Windsail Vest personal flotation device, by Mustang Sportswear Inc. of British Columbia, Canada and a personal flotation device manufactured by Stan Louden Products Ltd., Toronto, Canada are both examples of a flotation device having a hook member for attachment to a line. However, both devices are uncomfortable to wear when the line is attached to the hook and the wearer is leaning back as desired. First, because different wearers vary greatly in size, shape, and weight distribution, the hook member is not generally positioned in the most comfortable location. It may be too high or too low on the chest of the individual to be comfortable. Additionally, when the individual leans back, the point of attachment to the line may not be positioned with respect to his body to optimize his balance and support him properly.

It is also important that a flotation device used for sailboarding be easy to remove. Sailboards frequently tip over and even when they don't, the operators are often flipped from the sailboard. The personal flotation device can become entangled with the sailboard, particularly in view of the hook, and it can be critical that the wearer disengage himself quickly and easily from the device. The Mustang and the Stan Louden devices both require two hands for a relatively quick release. The prior art devices, including the Mustang and Louden devices, generally lack the ability to be easily and quickly released with one hand alone.

Some prior art devices such as the Stan Louden vest have straps or portions of straps incorporated on the inside of the vest where they can come in contact with the wear's skin. This can cause considerable discomfort because of the abrasive quality of the straps. Skin abrasions can easily occur with the use of such prior art devices. Even straps on the outside of prior art vests can cause discomfort to the wearer by pressing or cutting into the individual, particularly at high wind speeds where there is considerable stress or force on the individual as he leans back away from the line. These strap systems also generally fail to provide adequate support for comfort and balance in strong winds.

Prior art devices can also be overly bulky and uncomfortable due to the inclusion of buoyant material such as foam around substantially the entire circumference of the device. Such bulk can be particularly uncomfortable and restricting at an individual's sides where it can interfere with movement of the arms, particularly when the arms are in a lowered position. The bulk can become an even greater problem when the device is adjusted to fit the individual, for example, when straps are tightened around the device for a proper fit. When the straps are tightened, frequently the bulk will be gathered up or folded over on itself, causing even greater thicknesses and interference with free arm movement.

The present invention provides a personal flotation device for sailboard operators which is capable of being quickly and easily released with one hand, having a hook member adjustable in position for optimum comfort and balance, an inside surface free of straps or portions of straps, and strap arrangements which provide good comfort and support to the wearer. In a preferred embodiment it can also provide side panels free of buoyant material for added comfort and free arm movement.

SUMMARY OF THE INVENTION

The present invention relates to a personal flotation device for use in sailboarding. It is designed to be worn on the torso or upper body of an individual, namely, the wearer or sailboard operator. The device has a buoyant body portion having a top and bottom zone. The top zone is the general area which would be closer to the wearer's neck and shoulders, and the bottom zone would be the general area closer to the wearer's waist. This body portion comprises front and back sections, the front section being secured to the back section. At least one of the sections includes a mass of buoyant material. These sections have an inner or inside surface, which is the surface closest or proximate to the torso of the wearer, and an outer or outside surface.

The device has strap means for securing the body portion to and quickly releasing it from the wearer. The strap means is cooperatively connected to the body portion of the device.

The device also has means for releasably attaching it to a line of a sailboard. Using this means, the wearer can attach the device to the line, lean back, and be held up by the line. The releasably attaching means is carried by the strap means.

The device also has means for substantially distributing across the back of the wearer stress on the wearer which arises when the device is attached to the sailboard line and the wearer leans back.

BRIEF DESCRIPTION OF THE DRAWING

The invention will be better understood by reference to the Drawings.

FIG. 1 is a perspective view generally viewed as from above and to the right front of one embodiment of the sailboarding personal flotation device incorporating my present invention.

FIG. 2 is a perspective view generally viewed as from above and to the left front of the sailboarding personal flotation device shown in FIG. 1.

FIG. 3 is a perspective view generally viewed as from below and to the back right of the sailboarding personal flotation device shown in FIG. 1.

FIG. 6 is an enlarged perspective view of a portion of the sailboarding personal flotation device shown in FIG. 1, showing the hook and the adjacent area.

FIG. 7 is a cross-sectional view of a releasable clip of the sailboarding personal flotation device shown in FIG. 6 taken generally along line 7—7.

DETAILED DESCRIPTION OF THE INVENTION

Figure 4:
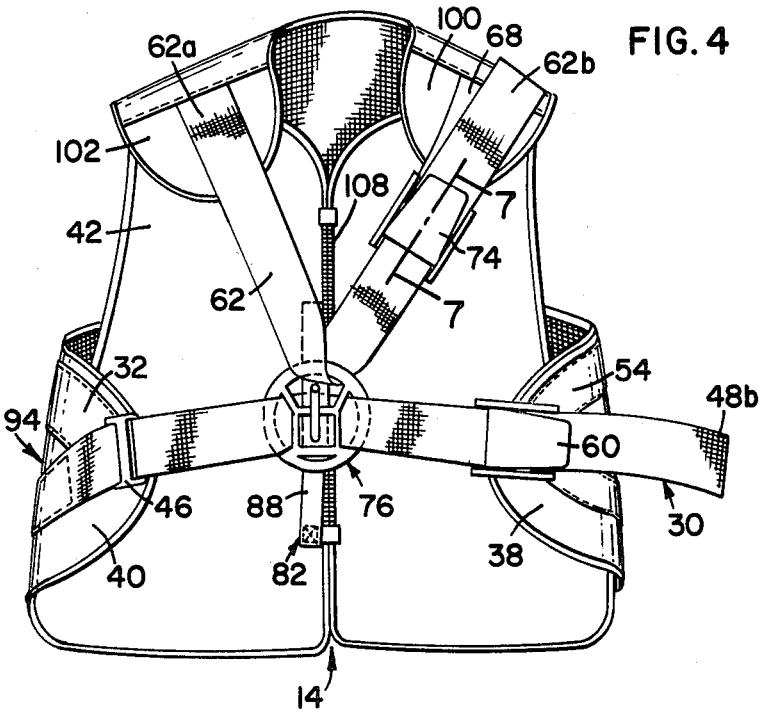
FIG. 4 is a front elevational view of the sailboarding personal flotation device shown in FIG. 1.

Referring now to the Drawings wherein like reference numerals denote like elements throughout the several views, there is generally designated at 10, a sailboarding personal flotation device. The embodiment illustrated in FIGS. 1–8 is in the nature of a vest having a buoyant body portion 12. Other embodiments can include a jacket-style device having sleeves. The buoyant body portion 12 has a front section 14 (as illustrated in FIG. 4) and a back section or panel 16. In a preferred embodiment, the buoyant body portion 12 comprises the back section or panel 16, and, comprising the front section 14, a right-front panel 18 having a center front edge 19, and a left-front panel 20. The back panel 16 has as general areas a top zone 16*a* and a bottom zone 16*b*. The right-front panel 18 has as general areas a top zone 18*a* and a bottom zone 18*b*. Similarly, the left-front panel 20 has as general areas a top zone 20*a* and a bottom zone 20*b*. The top zones are located generally near the upper chest, upper back, and shoulders of the wearer when the device is worn, while the bottom zones are located generally near the wearer's waist, or middle and lower back and abdomen. At least one of the panels or sections 16, 18 or 20 will comprise a buoyant mass such as closed-cell polyvinyl chloride foam or other foamed material, or the like. In the preferred embodiment, the back panel 16 is cooperatively connected to the right-front and left-front panels 18 and 20 at both the top zones and the bottom zones. More particularly, the back panel 16 and right front and left front panels 18 and 20 are connected in such a way as to define arm openings 26*a* and 26*b* and neck opening 28. The panels 16, 18 and 20 can be connected in any appropriate way such as stitching, lacing, stapling, hook and loop, adhesive cementing, and the like, or by any combination of these and other methods.

The sailboarding personal flotation device further comprises a strap means 30 for securing the body portion 12 to and quickly releasing it from the wearer. The strap means 30 are cooperatively connected to the body portion 12. They can be connected to the body portion 12 by stitching, fastener means, carrier loops, or the like.

In a preferred embodiment, the strap means 30 comprises a V-shaped strap 32 having first end 32*a* and second end 32*b*. The preferred strap means 30 further comprises flap-like members 38 and 40, attached to the body portion 12 and extending toward a front section 18 or 20. In a preferred embodiment including the flap-like members 38 and 40, both ends 32*a* and 32*b* of the V-shaped strap 32 are preferably attached to the same flap.

Figure 5:
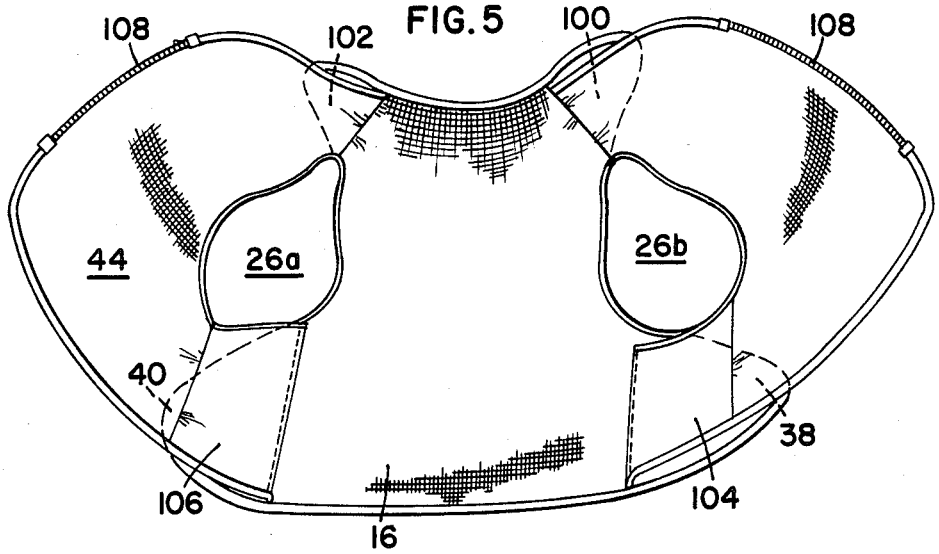
FIG. 5 is a front elevational view of the sailboarding personal flotation device shown in FIG. 1 as it appears on the inside surface when laid open.
Figure 8:
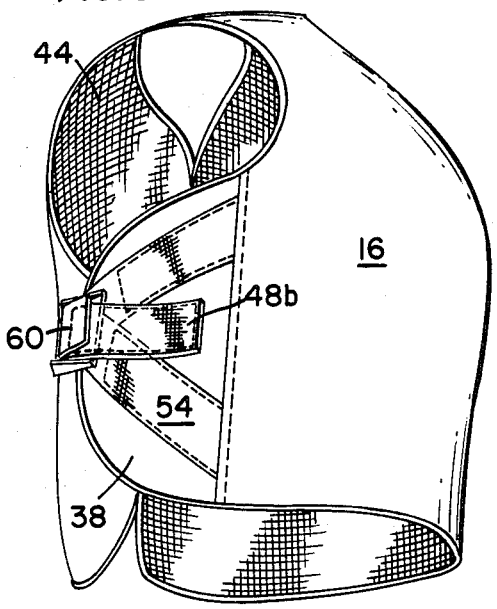
FIG. 8 is a perspective view generally viewed as from below and to the back left of the sailboarding personal flotation device shown in FIG. 1.

Preferably the strap means 30 is located on the outer or outside surface 42 of the device, with, as shown in FIG. 5, substantially no portion of the strap means 30 being incorporated on the inner or inside surface 44 of the device 10. Preferably, no straps will directly contact the wearer's torso.

In more detail, the preferred strap means 30 has a first strap 32 having a first end 32*a* and a second end 32*b*, both ends being attached at different points proximate to the intersection of the bottom zone 16*b* of the back panel 16 and the bottom zone 18*b* of the right front panel 18. Connected to the strap 32 is a joining member 46. The joining member 46 can be made of metal or other suitable material and can freely slide along strap 32 between the first end 32*a* and the second end 32*b*. A second strap 48 having a first end 48*a* and a second end 48*b* is cooperatively connected at the first end 48*a* to the joining member 46. A third strap 54, having first end 54*a* and second end 54*b* is attached at both ends 54*a* and 54*b* proximate to the intersection of the bottom zone 16*b* of the back section 16 and the bottom zone 20*b* of the left front panel 20, with both ends 54*a* and 54*b* of the third strap 54 being attached at different points. Cooperatively connected to the third strap 54 is a releasable clip or buckle 60, connected in such a way that it can freely slide along strap 54 between the first end 54*a* and the second end 54*b*. For example, clip 60 can provide an opening through which strap 54 passes and can freely slide. The clip 60 is designated for releasable engagement with the second strap 48 and can be substantially identical in form and operation to clip or buckle 74, later described in detail.

It is understood that other easily releasable fastening means which will hold the strap 48 securely can also be used in the context of this invention.

A fourth strap 62, having a first end 62*a* and a second end 62*b* is attached to the body portion 12 at the first end 62*a*, proximate to the intersection of the top zone 16*a* of the back panel 16 and the top zone 18*a* of the front panel 18. This strap is cooperatively connected to a ring-like member 78, later described in detail. As seen most clearly in FIG. 1, a fifth strap 68, having a first end 68*a* and a second end 68*b* is attached at the first end 68*a* to the body portion 12. The first end 68*a* is attached proximate to the intersection of the top zone 16*a* of the back panel 16 and the top zone 20*a* of the left front panel 20. Cooperatively connected to the second end 68*b* of the fifth strap 68 is a releasable clip or buckle 74. Clip 74 is designed for releasable engagement with the fourth strap 62. As seen most clearly in FIGS. 1 and 7, clip 74 can comprise a relatively large, easily grasped lever 61 having a first end 61*a* and a second end 61*b*. Clip 74 further comprises a housing 63 having sides 63*a*, 63*b*, and 63*c* between which lever 61 is positioned, and pivot pin 65 cooperatively connecting lever 61 at the first end 61*a* to the housing sides 63*a* and 63*b*. Lever 61 comprises protrusion 67, projecting outwardly from lever 61 substantially toward side 63*c*, while side 63*c* comprises a protrusion 69, which extends outwardly toward lever 61. To fasten device 10, strap 62 is passed through clip 74, that is, over side 63*c*, between sides 63*a* and 63*b*, and under lever 61 and pin 65. When lever 61 is positioned substantially parallel to the surface of the device 10, protrusions 67 and 69 cooperatively engage strap 62 and hold it securely. The cooperation or compression force between protrusions 67 and 69 and strap 62 causes the clip 74 to maintain its secure hold on strap 62 until second end 61*b* of lever 61 is pulled in a direction away from flotation device 10, pivoting at end 61*a* on pin 65. When lever end 61*b* is pulled away from device 10, protrusion 67 is removed from engagement with and therefore releases strap 62, allowing flotation device 10 to be released from the wearer. The pulling of lever end 61*b* to release strap 62 can easily be accomplished with only one hand.

Clip 74 can be made of aluminum or other metal, plastic, or any other suitable material. Other easily releasable fastening means which will securely hold strap 62 can also be used in the context of this invention.

It is understood that strap arrangements other than those shown in the Figures could be used with flotation device 10 of this invention. For example, the invention could comprise a strap arrangement having two or more points of attachment rather than one at each shoulder area, or more than two points of attachment at each side area, to further distribute the stress. As a further example, the strap means could comprise straps connected to the flotation device 10 arranged to secure the device 10 to the wearer, with more than one of the straps connected to a single buckle or clip. By pressing a button, pulling a lever, or the like to release the clip, the wearer could thus easily release with one motion more than a single strap, thus providing even greater ease for the removal of the device 10 from the wearer. It is envisioned that a single buckle in the nature of a parachute buckle device could be used for the entire strap means.

The sailboarding personal flotation device 10 of this invention includes a releasably attaching means 76 for releasably attaching the device 10 to a line of a sailboard in such a way that the wearer can attach the device 10 to the line, lean back, and be held up by the line, without the need for holding on to the sailboard with his arms and hands. As illustrated in Figure 6, preferably the releasably attaching means 76 comprises a ring-like member or ring 78 having cooperatively connected to it, a hook-like member or hook 80 for engaging a line. The ring-like member 78 is attached to the body portion 12 of the device 10 by the strap means 30, for example it can be carried by the strap means 30 as illustrated in the Figures.

The ring-like member 78 comprises an annular portion 77 having approximate quadrants 77*a*, 77*b*, 77*c*, and 77*d*. The ring-like member further comprises spokes 79*a*, 79*b*, 79*c*, and 79*d*, and a center portion 81 from which hook 80 protrudes. The spokes connect the center portion 81 to the annular portion 77, maintaining the center portion 81 in a somewhat protruding position relative to the annular portion 77. Strap 48 is threaded through the ring-like member 78, passing over the annular portion 77 at quadrant 77*d*, between spokes 79*a* and 79*d*, under center portion 81 and tape 88 which is later described in detail, between spokes 79*b* and 79*c*, over quadrant 77*b*, and across the left-front section 20 to releasable clip 60. In addition to strap 48, strap 62 is also threaded through ring-like member 78. Strap 62 passes over quadrant 77*a* and back under the same quadrant, and then up across the top zone 20*a* of left-front section 20 to releasable clip 74.

The invention of the instant application can further comprise a means 82 for self-adjusting the releasably attaching means 76. The self-adjusting means 82 allow the releasably attaching means 76 to be located at the proper balance point for the wearer when the device 10 is being worn and is releaseably attached or connected to a line of the sailboard, with the wearer leaning back. As illustrated in FIGS. 2, 4 and 6, the self-adjusting means 82 preferably comprises a tape or strap 88. Tape 88 comprises first and second ends 88*a* and 88*b* attached to the device 10 on front section 14 of the body portion 12. While it is shown that tape 88 is attached to right front panel 18, it is understood that tape 88 could instead be attached to left front panel 20. The tape 88 is positioned substantially parallel to the center front edge 19 of the right front panel 18. Between the tape 88 and the right front panel 18 is positioned the strap means 30, specifically, strap 48, carrying the releasable attaching means 76. Tape 88 has sufficient length to provide a distance between first and second ends 88*a* and 88*b* in which the strap means 30 can move horizontally and vertically between tape 88 and the body portion 12. Thus, if hook 80 is attached to the line of the sailboard, but hook 80, ring-like member 78 and strap means 30 are not at the proper balance point for the individual and thus cause greater instability of the sailboard and discomfort to the individual, the force on the sailboard will generally pull the hook 80, ring 78, and strap means 30 into a more appropriate position to provide better comfort and balance. The ends 88*a* and 88*b* of tape 88, being secured to the body portion 12, eliminate the risk that the hook-member 80, ring 78, and strap means 30 will be pulled too far, which could create a more dangerous and unstable situation.

The sailboarding personal flotation device 10 has means 94 for substantially distributing across the back of the wearer stress on the wearer which arises when the device 10 is attached to the line and the wearer leans back. As shown in FIGS. 1–4 and 8, this means comprises an arrangement or configuration of the strap means 30 such that the strap means 30 has at least two separate points of attachment with one area of the body portion 12. To further provide comfort and distribution of the stress, the device 10 comprises left and right side pad flaps 38 and 40. The left side pad flap 40 is cooperatively connected to the device 10 proximate to the intersection of the bottom zone 16*b* of the back panel 16 and the bottom zone 20*b* of the left front panel 20. The right side pad flap 38 is cooperatively connected to the device 10 proximate to the intersection of the bottom zone 16*b* of the back panel 16 and the bottom zone 18*b* right front panel 18. As can be seen in FIGS. 1–3 and 8, in a preferred embodiment, the first and second ends of straps 54 and the first and second ends of strap 32 are attached at different points to the respective flaps 38 and 40. Thus, when there is stress or pulling on the hook 80, this stress will be transferred by the strap arrangement across the lower or middle back of the individual wearing the flotation device 10, rather than merely to one small area.

As illustrated in FIG. 4, the flotation device 10 also comprises left and right shoulder pad flaps 100 and 102.

The left shoulder pad flap 100 is cooperatively connected to the device 10 proximate to the intersection of the top zone 16*a* of the back panel 16 and the top zone 20*a* of the left-bottom panel 20. The right shoulder pad flap 102 is cooperatively connected to the device 10 proximate to the intersection of the top zone 16*a* of the back panel 16 and the top zone 18*a* of the right-front panel 18. The shoulder pad flaps may be connected to the device 10 by stitching or other suitable means. As shown in FIGS. 1, 2 and 4, the fourth strap 62 is located over the right shoulder pad flap 102. Similarly, strap 68 is located over the left shoulder pad flap 100. These flaps 100 and 102 will generally help distribute the stress and, particularly if padded, will provide further padding and comfort to the individual so that the straps 62 and 68 will be less likely to cut into the wearer's shoulders.

A further feature of the flotation device 10 is left and right side panels 104 and 106, as can be seen in FIG. 5. Where the device 10 includes these side panels 104 and 106, the front panels 18 and 20 will generally be connected to the back panel 16 at the top zones 18*a* and 20*a*, but separated from the back panel 16 at the bottom zones 18*b* and 20*b* by the side panels 106 and 104 respectively. The left side panel 104 is cooperatively connected to both the back panel 16 and the left-front panel 20, defining part of arm opening 26*b*. The right side panel 106 is cooperatively connected to both the back panel 16 and the right-front panel 18, defining part of arm opening 26*a*. Preferably, the side panels 104 and 106 will be substantially free of any buoyant mass. This will eliminate bulk at the wearer's sides, particularly where the sides are bunched up or folded over on themselves by the strap means to provide a closer fit to the wearer's body. The side panels 104 and 106 can comprise any appropriate material, such as a strong flexible fabric. The side panels 104 and 106 can be cooperatively connected to the back panel 16 and front panels 18 and 20 by any appropriate means such as stitching, lacing, riveting, hook and loop, adhesive cementing, stapling, or any combination of these or other methods.

The sailboarding personal flotation device 10 includes a zipper 108 or other appropriate fastening means for releasably attaching the front sections 18 and 20 one to another. The zipper 108 aids in securing the device 10 to the wearer, but is designed for easy releasability with one hand so that the wearer can quickly and easily remove the flotation device 10 from the torso when necessary.

Obviously many modifications and variations of the present invention are possible in light of the above teachings. It is therefore understood that within the scope of the appended claims, the invention may be practiced otherwise than is specifically described.

I claim:

1. A sailboarding personal flotation device designed to be worn on the torso of a wearer comprising:

(a) a back panel, a right-front panel, and a left-front panel, each panel having a top zone and a bottom zone, the right-front and left-front panels being cooperatively connected to the back panel at both the top zones and bottom zones, at least one of the panels comprising a buoyant mass;

(b) a first strap having first and second ends, both ends being attached at different points proximate to the intersection of the bottom zones of the back panel and one of the front panels;

(c) a joining member connected to the first strap;

(d) a second strap having a first and second end, the first end being cooperatively connected to the joining member;

(e) a ring-like member having a hook protruding outwardly for releasably attaching the device to a line of a sailboard, such that the wearer can attach the device to the line, lean back, and be held up by the line, the ring-like member including an annular portion and a center portion, the center portion being interconnected to the annular portion by means of spokes, the spokes thereby dividing the ring-like member into a top quadrant, a bottom quadrant, a first lateral quadrant and a second lateral quadrant;

(f) means for self-adjustment of the position of the ring-like member to provide for the ring-like member to be located at the proper balance point for the wearer when the device is releasably attached to a line of the sailboard and the wearer leans back, comprising a tape having a first and second end, both ends being attached to the device near the front edge of a front panel, the tape being positioned substantially parallel to the front edge, the second strap being slidably connected to the ring-like member by means of the second end of the second strap being threaded sequentially through the first lateral quadrant such that the second strap passes between the center portion of the ring-like member and one of the front panels, the second strap next passing between the tape and the front panel, the second strap next passing through the second lateral quadrant, the tape having sufficient length to provide a limited distance between the first and second ends of the tape in which the second strap can move horizontally and, to a relatively lesser extent vertically, between the tape and the front panel;

(g) a third strap having first and second ends, both ends being attached at different points proximate to the intersection of the bottom zones of the back panel and the other front panel;

(h) a releasable clip cooperatively connected to the third strap, for engagement with the second strap;

(i) a fourth strap having a first and second end, the first end being attached proximate to the intersection of the top zone of the back panel and one of the front panels, the fourth strap being cooperatively connected to the ring-like member;

(j) a fifth strap having a first and second end, the first end being attached proximate to the intersection of the top zone of the back panel and the other front panel; and (k) a releasable clip cooperatively connected to the second end of the fifth strap, for engagement with the fourth strap.

2. The device of claim 1, further comprising left and right side panels, so that the front panels are connected to the back panel at the top zones, but are separated from the back panel by a side panel at the bottom zone, the left side panel being cooperatively connected to both the back panel and the left-front panel, the right side panel being cooperatively connected to both the back panel and the right-front panel, the side panels being substantially free of any buoyant mass.

3. The device of claim 1, further comprising left and right side pad flaps, the left side pad flap being cooperatively connected to the device proximate to the intersection of the bottom zones of back panel and left-front panel, the right side pad flap being cooperatively connected to the device proximate to the intersection of the bottom zones back panel and right-front panel, the first and second ends of the first strap being attached at different points to one of the left and right side pad flaps, the first and second end of the third strap being attached at different points to the other of the left and right side pad flaps.

4. The device of claim 3, further comprising left and right shoulder pad flaps, the left shoulder pad flap being cooperatively connected to the device proximate to the intersection of the top zones of the back panel and the left-front panel, the right shoulder pad flap being cooperatively connected to the device proximate to the intersection of the top zones of the back panel and the right-front panel.

5. A sailboarding personal flotation device designed to be worn on the torso of a wearer comprising:

(a) a back panel, a right-front panel, and a left-front panel, each panel having a top zone and a bottom zone, the right-front and left-front panels being cooperatively connected to the back panel at both the top zones and bottom zones, at least one of the panels comprising a buoyant mass;

(b) left and right-side pad flaps, the left-side pad flap being cooperatively connected to the device proximate to the intersection of the bottom zones of the back panels and the left-front panel, the right-side pad flap being cooperatively connected to the device proximate to the intersection of the back panel and the right-front panel;

(c)left and right shoulder pad flaps, the left shoulder pad being cooperatively connected to the device proximate to the intersection of the top zones of the back panel and the left-front panel, the right shoulder pad flap being cooperatively connected to the device proximate to the intersection of the top zones of the back panel and the right-front panel;

(d) a first strap having a first and second end, both ends being attached to one of the left and right-side pad flaps;

(e) a joining member connected to the first strap;

(f) a second strap having a first and second end, the first end being attached to the joining member;

(g) a ring-like member having a hook protruding outwardly for releasably attaching the device to a line of a sailboard, such that the wearer can attach the device to the line, lean back, and be held up by the line, the ring-like member including an annular portion and a center portion, the center portion being interconnected to the annular portion by means of spokes, the spokes thereby dividing the ring-like member into a top quadrant, a bottom quadrant, a first lateral quadrant and a second lateral quadrant;

(h) means for self-adjusting of the position of the ring-like member to provide for the ring-like member to be located at the proper balance point for the wearer when the device is releasably attached to a line of the sailboard and the wearer leans back, comprising a tape having a first and second end, both ends being attached to the device near the front edge of a front panel, the tape being positioned substantially parallel to the front edge, the second strap being slidably connected to the ring-like member by means of the second end of the second strap being threaded sequentially through the first lateral quadrant such that the second strap passes between the center portion of the ring-like member and one of the front panels, the second strap next passing between the tape and the front panel, the second strap next passing through the second lateral quadrant, the tape having sufficient length to provide a limited distance between the first and second ends of the tape in which the second strap can move horizontally and, to a relatively lesser extent vertically, between the tape and the front panel;

(i) a third strap having a first and second end, both ends being attached at different points on the other of the left and right-side pad flaps;

(j) a releasable clip cooperatively connected to the third strap, for engagement with the second strap.

(k) a fourth strap having a first and second end, the first end being attached to one of the shoulder pad flaps, the fourth strap being cooperatively connected to the ring-like member;

(1) a fifth strap having a first and second end, the first end being attached to the other shoulder pad flap; and (m) a releasable clip cooperatively connected to the second end of the fifth strap, for engagement with the fourth strap.

* * * * *

UNITED STATES PATENT AND TRADEMARK OFFICE

CERTIFICATE OF CORRECTION

PATENT NO. : 4,545,773

DATED : October 8, 1985

INVENTOR(S) : Karla R. Evert

It is certified that error appears in the above-identified patent and that said Letters Patent is hereby corrected as shown below:

Column 2, Line 6, for "wear's" read --wearer's--.
Column 6, Line 12, for "releaseably" read --releasably--.
Column 7, Line 4, for "left-bottom" read --left-front--.

Signed and Sealed this

*First* Day of *July 1986*

[SEAL]

*Attest:*

DONALD J. QUIGG

*Attesting Officer*

*Commissioner of Patents and Trademarks*